US008128382B2

(12) United States Patent
Smits

(10) Patent No.: US 8,128,382 B2
(45) Date of Patent: Mar. 6, 2012

(54) COMPACT DUAL ROCKING PISTON PUMP WITH REDUCED NUMBER OF PARTS

(75) Inventor: Troy Smits, Benton Harbor, MI (US)

(73) Assignee: Gast Manufacturing, Inc., Benton Harbor, MI (US)

( * ) Notice: Subject to any disclaimer, the term of this patent is extended or adjusted under 35 U.S.C. 154(b) by 120 days.

(21) Appl. No.: 12/110,902

(22) Filed: Apr. 28, 2008

(65) Prior Publication Data

US 2009/0016917 A1 Jan. 15, 2009

Related U.S. Application Data

(63) Continuation-in-part of application No. 11/776,310, filed on Jul. 11, 2007.

(51) Int. Cl.

| | |
|---|---|
| ***F04B 17/03*** | (2006.01) |
| ***F04B 35/04*** | (2006.01) |
| ***F04B 23/04*** | (2006.01) |
| ***F04B 41/06*** | (2006.01) |
| ***F04B 39/10*** | (2006.01) |
| ***F04B 53/10*** | (2006.01) |

(52) U.S. Cl. ..... 417/415; 417/521; 417/569

(58) Field of Classification Search ..... 417/521, 417/534, 569, 415, 486, 487, 419, 254
See application file for complete search history.

(56) References Cited

U.S. PATENT DOCUMENTS

| | | | | | |
|---|---|---|---|---|---|
| 1,983,260 | A | * | 12/1934 | Zorzi | 417/357 |
| 2,069,767 | A | * | 2/1937 | McCormack | 417/310 |
| 2,138,093 | A | * | 11/1938 | George et al. | 417/271 |
| 2,469,167 | A | * | 5/1949 | Little | 174/42 |
| 2,673,028 | A | * | 3/1954 | Cornelius et al. | 417/265 |
| 2,751,145 | A | * | 6/1956 | Olcott | 417/372 |
| 3,134,611 | A | * | 5/1964 | Iversen | 285/54 |
| 3,187,996 | A | * | 6/1965 | Knud | 417/312 |
| 3,211,365 | A | * | 10/1965 | Phelps | 417/319 |
| 3,273,596 | A | * | 9/1966 | Beckett | 138/30 |
| 3,385,515 | A | * | 5/1968 | Parker | 417/312 |
| 3,509,907 | A | * | 5/1970 | Gannaway | 137/512 |
| 3,839,946 | A | * | 10/1974 | Paget | 92/153 |
| 3,926,009 | A | * | 12/1975 | Parker et al. | 62/296 |
| 4,108,581 | A | * | 8/1978 | Miller et al. | 417/363 |
| 4,143,995 | A | * | 3/1979 | Divisi | 417/3 |

(Continued)

*Primary Examiner* — Devon C Kramer
*Assistant Examiner* — Bryan Lettman
(74) *Attorney, Agent, or Firm* — Miller, Matthias & Hull LLP

(57) ABSTRACT

A dual rocking piston pump which includes a first piston with a first connecting rod eccentrically mounted to a rotor shaft and a second piston with a second connecting rod eccentrically mounted to the rotor shaft. The rotor shaft passes through a first bearing and a second bearing before being connected to a rotor body. The rotor body is disposed within a stator. The first and second bearings and stator are supported by a bracket. The bracket includes a hub which, in turn includes a first end connected to a wall at an opening in the wall. The hub also includes a second end. The first end of the hub supports the first bearing at the wall and the second end of the hub supports the second bearing. Both the first and second bearings are disposed in front of the motor or in front of both the rotor and stator. Because support for the rotor is provided entirely in front of the motor, no rear bell housing is required and because a single bracket supports the bearings, rotor and stator, fewer parts are required thereby making the pump lighter and more compact.

10 Claims, 3 Drawing Sheets

U.S. PATENT DOCUMENTS 4,190,402 A * 2/1980 Meece et al. ..... 417/415
4,350,475 A * 9/1982 Meece et al. ..... 417/238
4,371,319 A * 2/1983 Murayama et al. ..... 417/312
4,479,419 A * 10/1984 Wolfe ..... 92/13.3
4,514,245 A * 4/1985 Chabrier ..... 156/161
4,696,626 A * 9/1987 Hata et al. ..... 417/312
4,788,944 A * 12/1988 Rascov ..... 123/47 R
4,844,705 A * 7/1989 Gannaway ..... 417/313
4,854,416 A * 8/1989 Lalikos et al. ..... 181/207
4,973,230 A * 11/1990 Da Costa ..... 417/312
5,205,719 A * 4/1993 Childs et al. ..... 417/312
5,339,652 A * 8/1994 Dreiman ..... 62/296
5,451,727 A * 9/1995 Park ..... 181/229
5,515,769 A * 5/1996 Basinski et al. ..... 92/80
5,677,046 A * 10/1997 Fawley et al. ..... 428/295.4
5,791,141 A * 8/1998 Phillips ..... 60/327
5,957,667 A * 9/1999 Epp ..... 417/271
6,155,067 A * 12/2000 Ono et al. ..... 62/296
6,155,800 A * 12/2000 Todescat et al. ..... 417/312
6,240,964 B1 * 6/2001 Cooper et al. ..... 138/30
6,325,600 B1 * 12/2001 Lilie et al. ..... 417/312
6,431,840 B1 * 8/2002 Mashimo et al. ..... 417/244
6,431,845 B1 8/2002 Thomas et al.
6,485,266 B2 * 11/2002 DeRuyter ..... 417/201
6,508,635 B2 * 1/2003 Kueon ..... 417/312
6,830,440 B1 12/2004 Riddoch
6,832,900 B2 * 12/2004 Leu ..... 417/419
7,037,090 B2 * 5/2006 Leu ..... 417/415
7,137,263 B2 11/2006 Collins et al.
2002/0009370 A1 * 1/2002 Kueon ..... 417/63
2005/0042113 A1 * 2/2005 Lee ..... 417/312
2005/0175474 A1 * 8/2005 Lee et al. ..... 417/363
2006/0028088 A1 * 2/2006 McFarland et al. ..... 310/239
2006/0251527 A1 * 11/2006 Wester ..... 417/312
2006/0275160 A1 12/2006 Leu et al.
2006/0284502 A1 * 12/2006 Lu ..... 310/89
2007/0041855 A1 * 2/2007 Hansen et al. ..... 417/417

* cited by examiner 10
41
45
41
33
37
36
23
21
25
25
54
15
56
22
24
26

10
51
21
55
37
22
54
52
26
52
53
10
56
45

COMPACT DUAL ROCKING PISTON PUMP WITH REDUCED NUMBER OF PARTS

CROSS REFERENCE TO RELATED APPLICATIONS

This is a continuation-in-part of U.S. application Ser. No. 11/776,310, filed on Jul. 11, 2007.

BACKGROUND

1. Technical Field

Improved dual rocking piston pumps are disclosed that employ a cantilevered rotor and stator supported by a single bracket without the need for a rear bell housing thereby providing a compact design. The disclosed pumps may be made with fewer parts than conventional dual rocking piston pumps, therefore resulting in lower manufacturing costs and reduced weight in a compact design.

2. Description of the Related Art

Dual rocking piston compressors, diaphragm compressors and vacuum pumps all use the reciprocating motion of a piston to produce increased pressures within a control volume, such as a cylinder. The length of the stroke of the piston determines the compression ratio for the fixed control volume. Dual rocking piston pumps are often used for medical applications, such as used in oxygen concentrators, because they are compact.

One problem with conventional dual rocking piston pumps is that they can create noise and vibration as the pistons reciprocally stroke, especially if the two pistons are designed for different outputs, thereby leading to balancing problems. If each piston assembly produces a different output, different rod top/retainer/diaphragm diameters, forces of different magnitudes are imposed on the drive shaft by each piston assembly. Shaking or vibrations arise as the drive shaft rotates because of the imbalance in the forces imposed by each piston assembly. Further, it is often desirable to design dual rocking piston pumps with unequal piston strokes. A dual opposed rocking piston pump with unequal strokes is also inherently out of balance. Because the strokes are different, the opposed reciprocating piston assemblies are traveling different distances during each revolution. As a result, the acceleration of one piston assembly is not equal to the acceleration of the other piston assembly. The diameters of the retainers, rod tops or diaphragms may or may not be equal and the mass of the opposed reciprocating components may or may not be equal. As a result, the forces created by the opposed reciprocating components may not be equal resulting in unwanted shaking, vibration or noise. Co-pending U.S. application Ser. No. 11/776,310 addresses this problem, and is incorporated herein by reference.

However, it would be desirable to reduce the size, weight and number of required parts for dual rocking piston pumps. Obviously, pumps used in medical applications and other applications where the pump is moved need to be lightweight, as well as reliable. Similarly, the pumps should have a compact design which renders them easy to incorporate into existing equipment and environments. Any design changes, of course, must not result in compromising the recent improvements in terms of noise and vibration.

Accordingly, there remains a need for an improved rocking piston pump or compressor with excellent balance and quiet operation that, is also lightweight, compact and requires fewer parts, without making the pump noisy or compromising the reliability or efficiency of the pump.

SUMMARY OF THE DISCLOSURE

In satisfaction of the aforenoted needs, an improved dual rocking piston pump is disclosed which comprises a first piston comprising a first connecting rod eccentrically mounted to a rotor shaft and a second piston comprising a second connecting rod eccentrically mounted to the rotor shaft. The rotor shaft passes through a first bearing and a second bearing before being connected to a rotor body. The rotor body is disposed within a stator. The first and second bearings and stator are supported by a bracket. The bracket comprises a hub which, in turn comprises a first end connected to a wall at an opening in the wall. The hub also comprises a second end. The first end of the hub supports the first bearing at the wall and the second end of the hub supports the second bearing. Both the first and second bearings are disposed to "in front" of the motor or in front of both the rotor and stator.

Thus, a single bracket supports the first and second bearings, the rotor and rotor shaft and the stator. No rear bell housing is required.

In a refinement, the bracket further comprises a support member extending outward from the wall and parallel to the hub. The support member engages a front annular surface of the stator and supports the stator. The support member may be cylindrical or may include a plurality of coaxial support members that engage an outer surface of the stator. Further, in addition to the one or more support members that support the stator, the stator may be bolted or otherwise connected to the bracket. Preferably, the hub and support member are connected perpendicularly to the wall of the bracket. The support members may also act as a protective wall or shield for the bolts that connect the stator to the bracket. Specifically, the bolts can pass through an outer annular surface of the stator, and radially inside of the support members (between the support members and the hub) before they are connected to the wall of the bracket.

As a result, the disclosed design places the front and rear bearings on the front side of the rotor, or the rotor shaft side of the rotor. One key advantage of the disclosed design is that one bracket can house and support both motor bearings and support the rotor and stator instead of relying upon multiple brackets. Prior art designs require a rear end bell housing that houses the rear bearing on the rear side of the motor. The disclosed design eliminates the rear end bell to reduce the size of the pump, in addition to reducing manufacturing costs, number of parts and weight.

Other advantages and features will be apparent from the following detailed description when read in conjunction with the attached drawings.

BRIEF DESCRIPTION OF THE DRAWINGS

For a more complete understanding of the disclosed methods and apparatuses, reference should not be made to the embodiment illustrated in greater detail on the accompanying drawings, wherein.

It should be understood that the drawings are not necessarily to scale and that the disclosed pumps or compressors are sometimes illustrated diagrammatically and in partial views. In certain instances, details which are not necessary for an understanding of the disclosed pumps or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
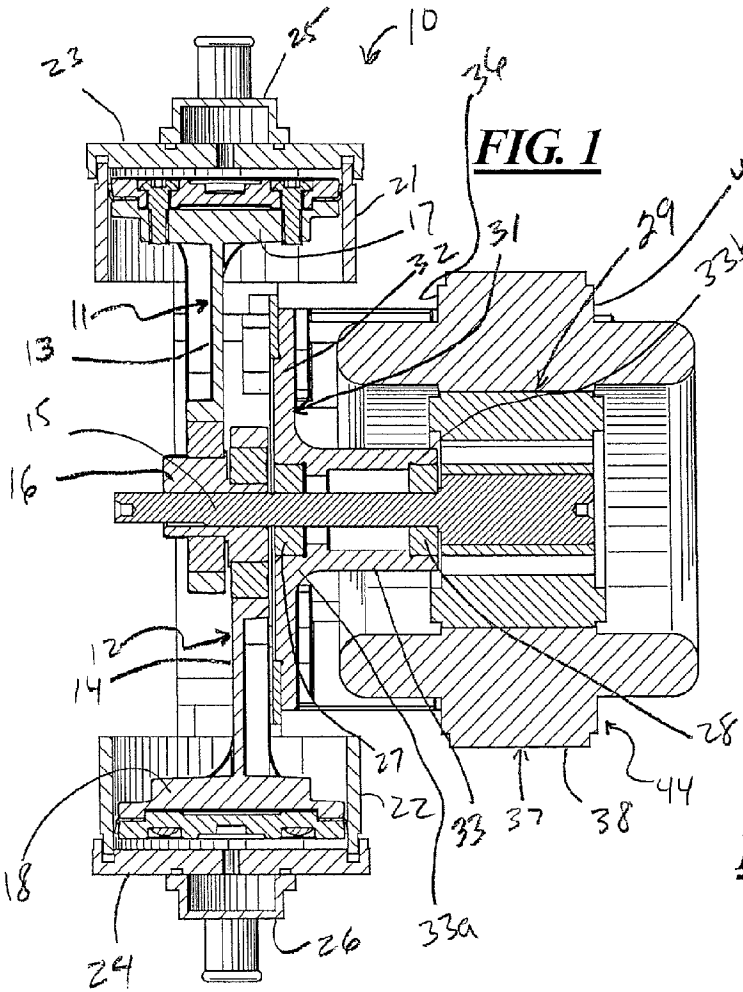
FIG. 1 is a sectional view of a dual rocking piston pump or compressor made in accordance with this disclosure and taken substantially along line 1-1 of FIG. 2.
Figures 3, 4:
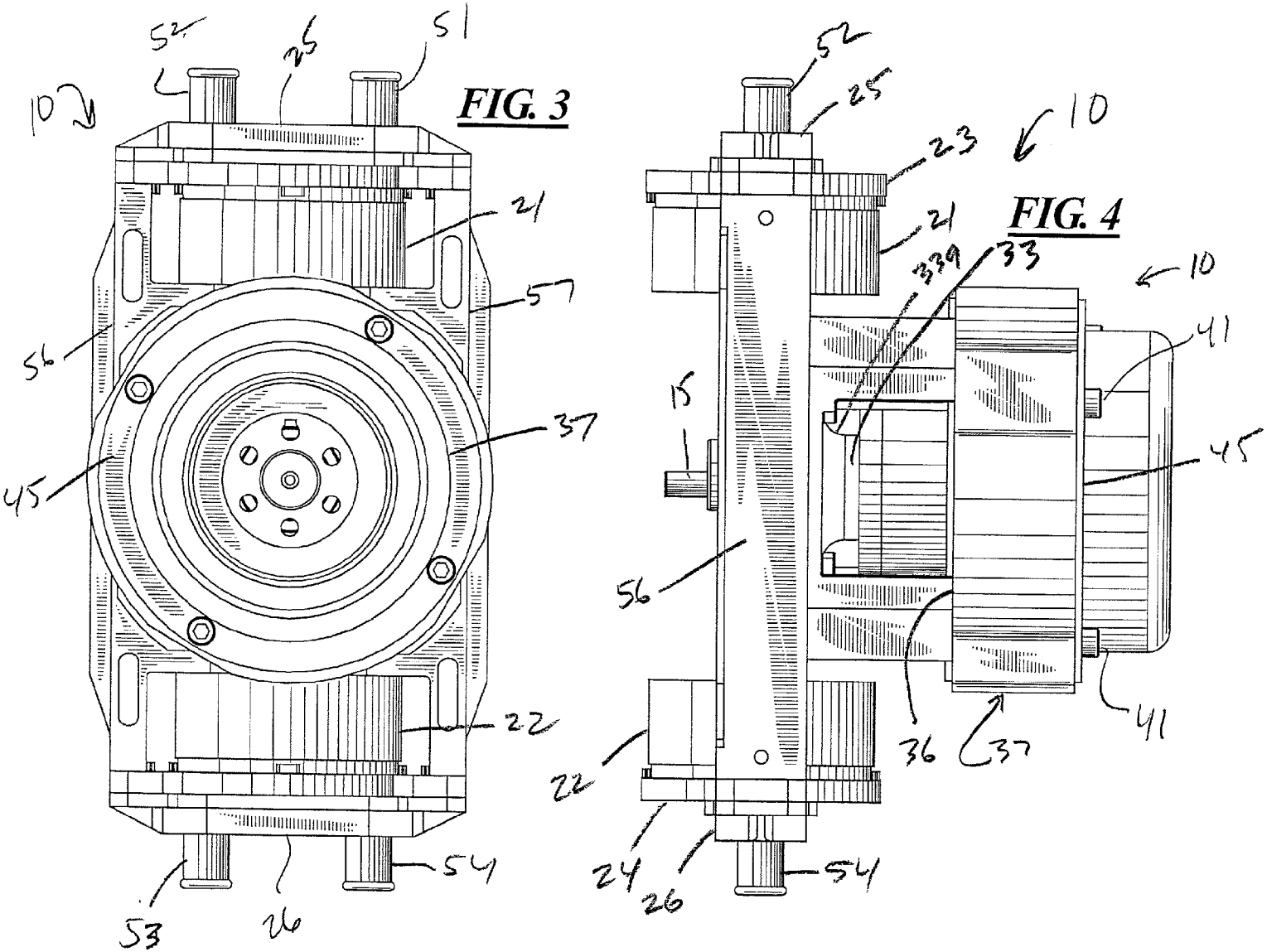
FIG. 3 is a rear plan view of the pump shown in FIGS. 1-2.
FIG. 4 is a side plan view of the pump shown in FIGS. 1-3.

FIG. 1 provides a sectional view of a pump or compressor 10 made in accordance with this disclosure. Before explaining the benefits provided by the design of the pump 10 as illustrated in FIGS. 1-5, an initial description of the parts disclosed in the exploded view of FIG. 6 is in order.

Figure 6:
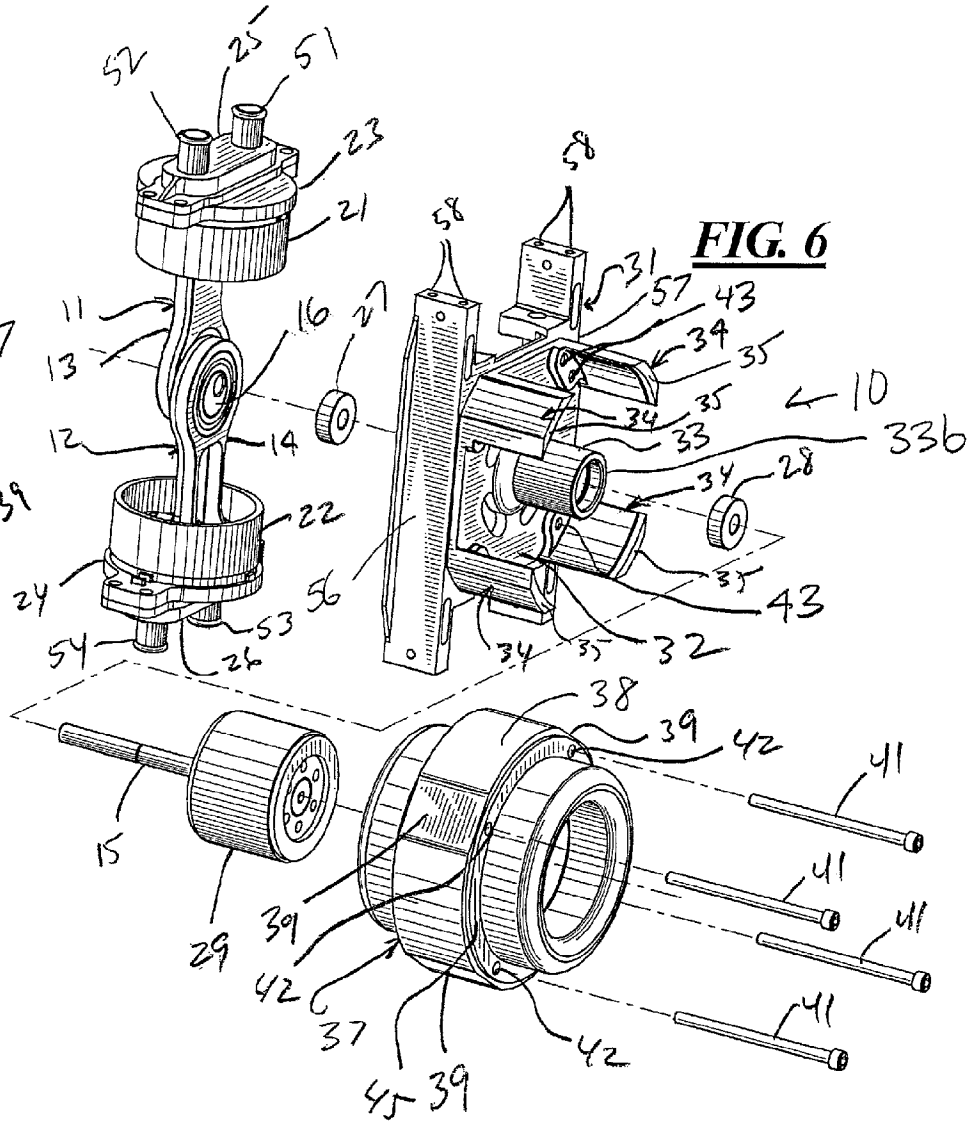
FIG. 6 is an exploded view of the pump shown in FIGS. 1-5.
Figure 5:
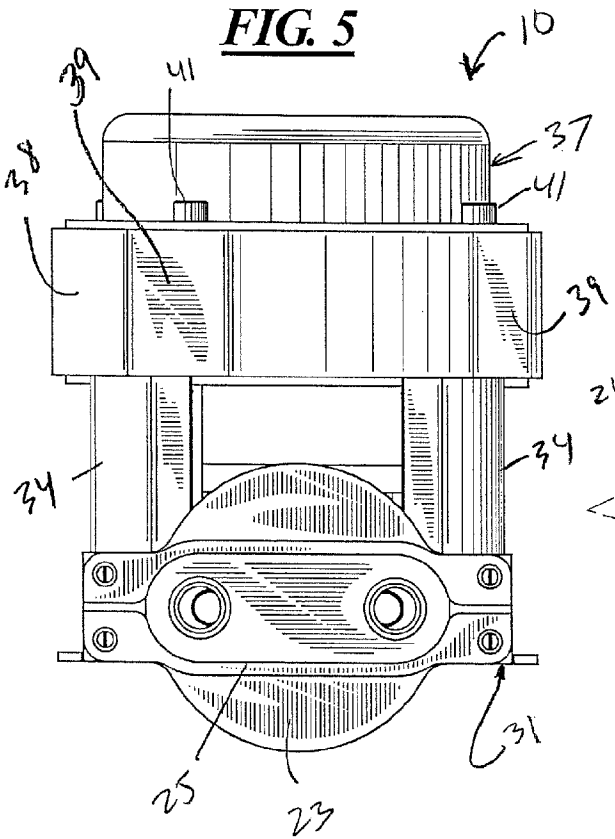
FIG. 5 is top plan view of the pump shown in FIGS. 1-4.

Therefore, referring to FIG. 6, the pump 10 includes two rod assemblies 11, 12 that include connecting rods 13, 14 eccentrically mounted to a rotor shaft 15 by an eccentric member 16 as is known in the art and also illustrated in co-pending application Ser. No. 11/776,310. The connecting rods 13, 14 are connected to rod tops 17, 18 as shown in FIG. 1. The rod tops 17, 18 are disposed within cylinders 21, 22. Each cylinder 21, 22 is connected to a valve plate 23, 24 which, in turn, is sandwiched between a head 25, 26 and its respective cylinder 21, 22.

Two bearings 27, 28 are used to support a rotor shaft 15 and rotor 29. The first bearing 27 is disposed adjacent the connecting rod 14 and the eccentric 16 and is supported by the bracket 31, which includes a wall 32 and hub 33. The unitary bracket 31 also includes at least one support member, and in this case, four support members 34 concentrically arranged around the hub 33 and connected in a perpendicular fashion to the wall 32. The end surfaces 35 of the support members 34 engage and support the stator 37 along its front annular surface 36. The recessed or indented areas shown at 39 along the outer surface 38 of the stator 37 maybe provided for properly aligning the stator 37 with the support members 34 and/or facilitating insertion of the bolts 41 through the openings 42 in the rear annular surface 45 of the stator 37 to the holes 43 in the wall 32 of the bracket 31 for the purpose of securing the stator 37 to the bracket 31.

Returning to FIG. 1, the hub 33 includes a first end 33*a* that supports the first bearing 27 and a second end 33*b* that supports a second bearing 28. The hub 33 is also connected to and unitary with the wall 32 of the bracket 31. Thus, the single bracket 31, which includes the wall 32 and hub 33, supports both bearings 27, 28 in front of the rotor 29/stator 37 combination assembly 44, which includes the stator 37 and the rotor 29. The bracket 31 also provides support for the stator 37, which is secured to the bracket 31 by the bolts 41 passing through the holes 42 in the outer annular surface 45 of the stator 37 before being connected to the wall 32 of the bracket 31.

Figure 2:
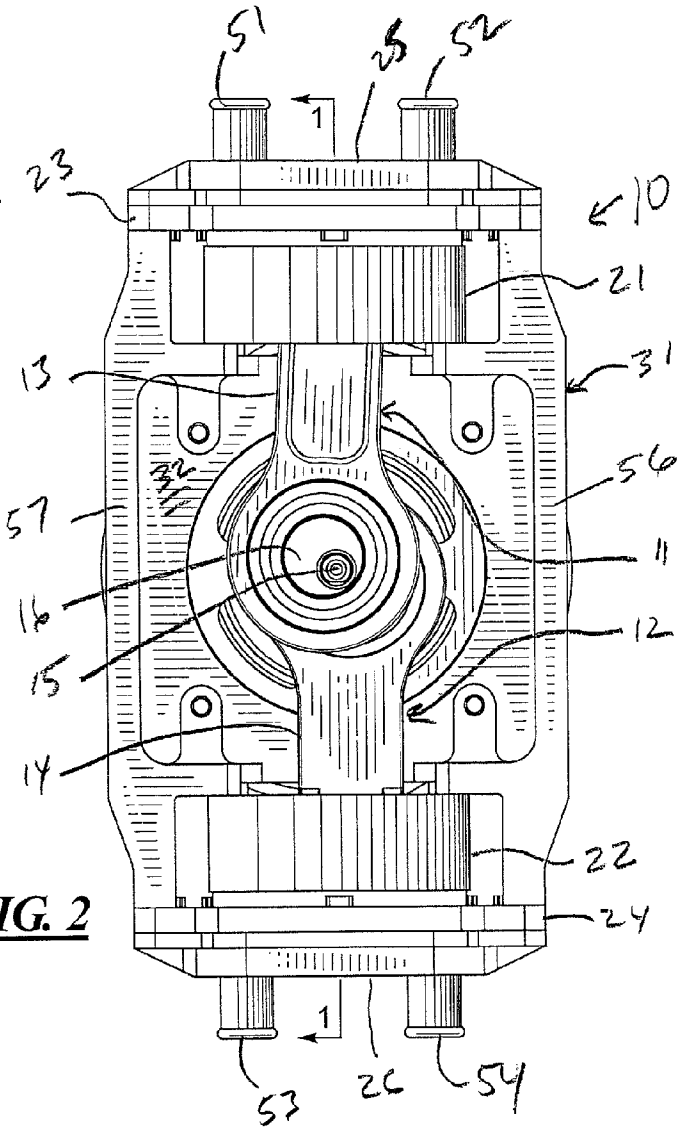
FIG. 2 is a front plan of the pump shown in FIG. 1.

FIGS. 2-5 provide additional views of the parts/elements discussed above in addition to other parts/elements of the pump 10. Specifically, each head 25, 26 includes input and output ports 51-54 as shown in FIG. 2. As shown in FIG. 1, the eccentric member 16 has a unitary structure. However, dual eccentric members, or one eccentric member for each connecting rod 13, 14 may be employed. It will be noted that the bracket 31 has an H-shaped configuration, with the wall 32 being disposed between upright members 56, 57. The upright members 56, 57 include holes 58 for connecting the heads 25, 26 to either end of the upright members 56, 57. The top plan view of FIG. 5 and side plan view of FIG. 4 particularly illustrate the compact design of the pump 10 which does not require a rear end bell because the rotor 29 and rotor shaft 15 are supported by the two bearings 27, 28 disposed entirely in front of the rotor 29/stator 37 combination.

The design shown in FIGS. 1-6 is substantially more compact than the designs of similar opposed rocking piston pumps, which typically require a rear end bell structure for housing a rear bearing disposed opposite the rotor and stator from the connecting rods. The design of FIGS. 1-6 is also substantially more compact and lighter than competitive dual piston pumps.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A dual rocking piston pump comprising:

a first piston comprising a first connecting rod eccentrically mounted to a horizontal rotor shaft, the first piston being slidably accommodated through an open inner end of a stationary first cylinder, the first cylinder having an outer end closed by a first valve plate, a second piston comprising a second connecting rod eccentrically mounted to the horizontal rotor shaft, the second piston being slidably accommodated through an open inner end of a stationary second cylinder, the second cylinder having an outer end closed by a second valve plate, the first and second cylinders and first and second valve plates are disposed on diametrically opposite sides of the rotor shaft from one another with both connecting rods disposed therebetween, the horizontal rotor shaft passing through the first and second connecting rods, a first bearing and a second bearing before being connected to and terminating at a rotor body, the rotor body being disposed within a stator, the first and second bearings and stator being supported by a unitary bracket, the bracket comprising a hub comprising a first end connected to a wall of the bracket at an opening in the wall, the wall separating the pistons and cylinders from the rotor and stator, the hub comprising a second end, the first end of the hub comprising a first radial groove for supporting the first bearing at the wall, the second end of the hub comprising a second radial groove for supporting the second bearing, the rotor shaft passing though and engaging the first and second bearings, the bracket, first bearing and second bearing being disposed axially between the rotor body and the first and second pistons and spaced apart from the rotor body and the first and second pistons, the bracket further comprising at least one support member extending horizontally outward from the wall and parallel to the hub, the support member comprising an inner surface that engages an outer surface of the stator and supporting the stator, the inner surface of the support being arcuate and the outer surface of the stator being arcuate, the arcuate surfaces of the support and stator being concentric with the hub and rotor shaft, the stator also being coupled to the wall of the bracket by a plurality of fasteners that pass through at least part of the stator.

2. The pump of claim 1 wherein the support member is cylindrical.

3. The pump of claim 1 wherein the at least one support member comprises a plurality of support members, and each fastener passing through the stator and being disposed radially inside one of the support members.

4. The pump of claim 3 wherein the plurality of support members comprises four support members, and the plurality of fasteners comprises four bolts.

5. The pump of claim 1 wherein the rotor shaft and an axis of the hub are perpendicular to the wall.

6. The pump of claim 1 wherein the hub is cylindrical.

7. A dual rocking piston pump comprising:

a first piston comprising a first connecting rod eccentrically mounted to a horizontal rotor shaft, the first piston being slidably accommodated through an open inner end of a stationary first cylinder, the first cylinder having an outer end closed by a first valve plate, a second piston comprising a second connecting rod eccentrically mounted to the horizontal rotor shaft, the second piston being slidably accommodated through an open inner end of a stationary second cylinder, the second cylinder having an outer end closed by a second valve plate, the horizontal rotor shaft passing through the first and second connecting rods, a first bearing and a second bearing before being connected to a rotor body, the first and second cylinders and first and second valve plates are disposed on diametrically opposite sides of the rotor shaft from one another with both connecting rods disposed therebetween, the rotor body being disposed within a stator, the first and second bearings and stator being supported by a unitary bracket, the rotor shaft passing though and engaging the first and second bearings, the bracket comprising a hub comprising a first end connected to a wall at an opening in the wall, the wall of the bracket separating the pistons and cylinders from the rotor and stator, the hub comprising a second end, the first end of the hub comprising a first radial groove for supporting the first bearing at the wall, the second end of the hub comprising a second radial groove for supporting the second bearing, the first and second pistons being disposed on one side of the wall, the second bearing, rotor body and stator being disposed on an other side of the wall, the bracket, first bearing and second bearing being disposed axially between the rotor body and the first and second pistons and spaced apart from the rotor body and the first and second pistons, the stator being connected to the bracket by a plurality of fasteners that pass through at least part of the stator, the bracket further comprising a plurality of support members extending outward from the wall and parallel to the hub, the support members engaging and supporting an outer surface of the stator, each fastener disposed between one of the support members and the hub, the bracket further comprising a pair of upright support members disposed on either side of the rotor shaft and perpendicular to the rotor shaft, inner surfaces of the support members being arcuate and the outer surface of the stator being arcuate, the arcuate surfaces of the support members and stator being concentric with the hub and rotor shaft.

8. The pump of claim 7 wherein the rotor shaft and an axis of the hub are perpendicular to the wall.

9. The pump of claim 7 wherein the plurality of support members comprises four support members, each of which engages the outer surface of the stator, and the plurality of fasteners comprises four bolts.

10. A dual rocking piston pump comprising:

a first piston comprising a first connecting rod eccentrically mounted to a horizontal rotor shaft, the first piston being slidably accommodated through an open inner end of a stationary first cylinder, the first cylinder having an outer end closed by a first valve plate, a second piston comprising a second connecting rod eccentrically mounted to the horizontal rotor shaft, the second piston being slidably accommodated through an open inner end of a stationary second cylinder, the second cylinder having an outer end closed by a second valve plate, the horizontal rotor shaft passing through and engaging both a first bearing and a second bearing before being connected to a rotor body, the rotor body being disposed within a stator, the first and second cylinders and first and second valve plates are disposed on diametrically opposite sides of the rotor shaft from one another with both connecting rods disposed therebetween, the first and second bearings and stator being supported by a unitary bracket, the bracket comprising a cylindrical hub comprising a first end perpendicularly connected to a wall of the bracket and surrounding an opening in the wall, the wall separating the pistons and cylinders from the rotor and stator, the hub comprising a second end, the first end of the hub comprising a first radial groove for supporting the first bearing at the wall, the second end of the hub comprising a second radial groove for supporting the second bearing, the first and second pistons being disposed on one side of the wall, the second bearing, rotor body and stator being disposed on an other side of the wall, the bracket, first bearing and second bearing being disposed axially between the rotor body and the first and second pistons and spaced apart from the rotor body and the first and second pistons, the stator being connected to the bracket by a plurality of bolts that pass through an annular outer surface of the stator before being threadably connected to the wall of the bracket, the bracket further comprising a plurality of support members extending outward from the wall and parallel to the hub, the support members engaging an outer surface of the stator and supporting the stator, an inner surface of the support members being arcuate and the outer surface of the stator being arcuate, the arcuate surfaces of the support members and stator being concentric with the hub and rotor shaft.

* * * * *